US009576521B2

(12) United States Patent
Yachida

(10) Patent No.: US 9,576,521 B2
(45) Date of Patent: Feb. 21, 2017

(54) DRIVE DEVICE AND DRIVE METHOD FOR VACUUM FLUORESCENT DISPLAY

(71) Applicant: NIPPON SEIKI CO., LTD., Niigata (JP)

(72) Inventor: Takeshi Yachida, Niigata (JP)

(73) Assignee: NIPPON SEIKI CO., LTD., Niigata (JP)

( * ) Notice: Subject to any disclaimer, the term of this patent is extended or adjusted under 35 U.S.C. 154(b) by 0 days.

(21) Appl. No.: 14/654,381

(22) PCT Filed: Dec. 12, 2013

(86) PCT No.: PCT/JP2013/083300

§ 371 (c)(1),
(2) Date: Jun. 19, 2015

(87) PCT Pub. No.: WO2014/097955

PCT Pub. Date: Jun. 26, 2014

(65) Prior Publication Data

US 2015/0348461 A1 Dec. 3, 2015

(30) Foreign Application Priority Data

Dec. 20, 2012 (JP) ..... 2012-278542

(51) Int. Cl.
*G09G 3/34* (2006.01)
*G09G 3/22* (2006.01)

(52) U.S. Cl.
CPC ..... *G09G 3/22* (2013.01); *G09G 3/3406* (2013.01); *G09G 3/3486* (2013.01);
(Continued)

(58) Field of Classification Search
CPC ..... G09G 2310/0237; G09G 2320/0233; G09G 3/3486; G09G 2310/0254; G09G 2330/028; G09G 2300/08; G09G 3/3406; G09G 3/22
(Continued)

(56) References Cited

U.S. PATENT DOCUMENTS 5,347,292 A * 9/1994 Ge ..... H01J 9/185 313/309
5,814,931 A 9/1998 Makishima
(Continued)

FOREIGN PATENT DOCUMENTS

JP 4-220690 A 8/1992
JP 5-13181 A 1/1993
(Continued)

OTHER PUBLICATIONS

International Search Report PCT/JP2013/083300 dated Mar. 11, 2014 with English translation.

*Primary Examiner* — Andrew Sasinowski
*Assistant Examiner* — Chineyere Wills-Burns
(74) *Attorney, Agent, or Firm* — McDermott Will & Emery LLP

(57) ABSTRACT

Provided are a drive device and drive method for a vacuum fluorescent display that can suppress brightness variations in display images and improve display quality. A drive device for a vacuum fluorescent display is provided with a positive electrode unit in which a plurality of positive electrodes to which a phosphor is applied are disposed in a matrix shape and a negative electrode filament that discharges electrons toward the positive electrode unit. The device is provided with: a first magnetic field generating means that generates a first magnetic field perpendicular to the direction in which the positive electrode unit and the negative electrode filament face each other and that can periodically switch polarity; and a second magnetic field generating means that generates a second magnetic field that is perpendicular to the direction in which the positive electrode unit and the negative electrode filament face each other and crosses the first magnetic field and that can periodically switch polarity.

4 Claims, 6 Drawing Sheets

(52) U.S. Cl.
CPC . *G09G 2300/08* (2013.01); *G09G 2310/0237* (2013.01); *G09G 2310/0254* (2013.01); *G09G 2320/0233* (2013.01); *G09G 2330/028* (2013.01)

(58) Field of Classification Search
USPC ..... 345/690
See application file for complete search history.

(56) References Cited

U.S. PATENT DOCUMENTS

| | | | | |
|---|---|---|---|---|
| 6,525,463 | B1 * | 2/2003 | Choi | H01J 31/127 313/497 |
| 2003/0025467 | A1 * | 2/2003 | Tanaka | G09G 1/04 315/370 |
| 2010/0194788 | A1 * | 8/2010 | Kikuta | G09G 3/04 345/690 |

FOREIGN PATENT DOCUMENTS

| | | | |
|---|---|---|---|
| JP | 9-115426 | A | 5/1997 |
| JP | 9-288467 | A | 11/1997 |
| JP | 2004-87404 | A | 3/2004 |

* cited by examiner (a) FIRST ALTERNATING CURRENT (b) SECOND ALTERNATING CURRENT (a)

(b)

DRIVE DEVICE AND DRIVE METHOD FOR VACUUM FLUORESCENT DISPLAY

CROSS-REFERENCE TO RELATED APPLICATIONS

The subject application is the U.S. National Phase of PCT/JP2013/083300 filed Dec. 12, 2013, which claims priority to Japanese Patent Application No. 2012-278542 filed Dec. 20, 2012. The subject matter of each is incorporated herein by reference in entirety.

TECHNICAL FIELD

The present invention relates to a driving device and a driving method for a vacuum fluorescent display.

BACKGROUND ART

As an exemplary vacuum fluorescent display (VFD), a configuration disclosed in Patent Literature 1 is known. This vacuum fluorescent DISPLAY is an active matrix type vacuum fluorescent display in which a plurality of fluorescent substance-coated anodes are arranged in a matrix pattern, a positive voltage is selectively applied to these anodes to cause thermoelectrons emitted from a cathode filament to collide with the fluorescent substance on arbitrary anodes, whereby a luminous display of a desired image is performed.

CITED REFERENCE

Patent Literature

Patent Literature 1: Japanese Patent Application Laid-open No. 2004-87404

Patent Literature 2: Japanese Patent Application Laid-open No. 5-13181

SUMMARY OF THE INVENTION

Problems to be Solved by the Invention

An active matrix type vacuum fluorescent display has a problem that luminance unevenness occurs when a positive voltage is applied to a plurality of anodes. This is because, since a positive electric field is generated in anodes in an ON state to which a positive voltage is applied, and a negative electric field is generated in anodes in an OFF state, a deviation occurs in the electric field between a central region and a peripheral region of a plurality of anodes in the ON state and, electrons are easily collected and luminance easily becomes high in the central region and electrons do not easily reach the peripheral region and luminance becomes low in the peripheral region. As an alternative, Patent Literature 2 discloses a method for obtaining stable uniform luminance by causing a magnetic field to generate in a direction vertical to a direction in which electrons move, regarding a driving device for a flat fluorescence tube used for, for example, a backlight of a liquid crystal display.

The method disclosed in Cited Literature 2, however, merely makes the luminance uniform in the direction vertical to the direction in which the electrons move, and therefore has room for improvement in raising display quality about driving an active matrix type vacuum fluorescent display that displays images.

The present invention is made in view of the aforementioned circumstance, and an object thereof is to provide a driving device and a driving method for a vacuum fluorescent display capable of reducing luminance unevenness of a display image and improving a display quality.

Means for Solving the Problem

To achieve the above object, a present invention is summarized as a driving device for a vacuum fluorescent display which includes: an anode unit constituted by a plurality of fluorescent substance-coated anodes arranged in a matrix pattern, and a cathode filament that emits electrons toward the anode unit, the device comprising: a first magnetic field generating means configured to generate a first magnetic field vertical to a direction in which the anode unit and the cathode filament face each other, and of which polarity is switchable periodically; and a second magnetic field generating means configured to generate a second magnetic field vertical to a direction in which the anode unit and the cathode filament face each other and crossing the first magnetic field, and of which polarity is switchable periodically.

To achieve the above object, a present invention is summarized as a driving method for a vacuum fluorescent display which includes: an anode unit constituted by a plurality of fluorescent substance-coated anodes arranged in a matrix pattern, and a cathode filament that emits electrons toward the anode unit, the method comprising generating a first magnetic field vertical to a direction in which the anode unit and the cathode filament face each other and a second magnetic field vertical to a direction in which the anode unit and the cathode filament face each other and crossing the first magnetic field, with the directions switched periodically.

Effect of the Invention

According to the present invention, a driving device and a driving method for a vacuum fluorescent display capable of reducing luminance unevenness of a display image and improving a display quality can be provided.

MODE FOR CARRYING OUT THE INVENTION

A driving device for a vacuum fluorescent display according to an embodiment of the present invention will be described with reference to the drawings.

Figure 1:
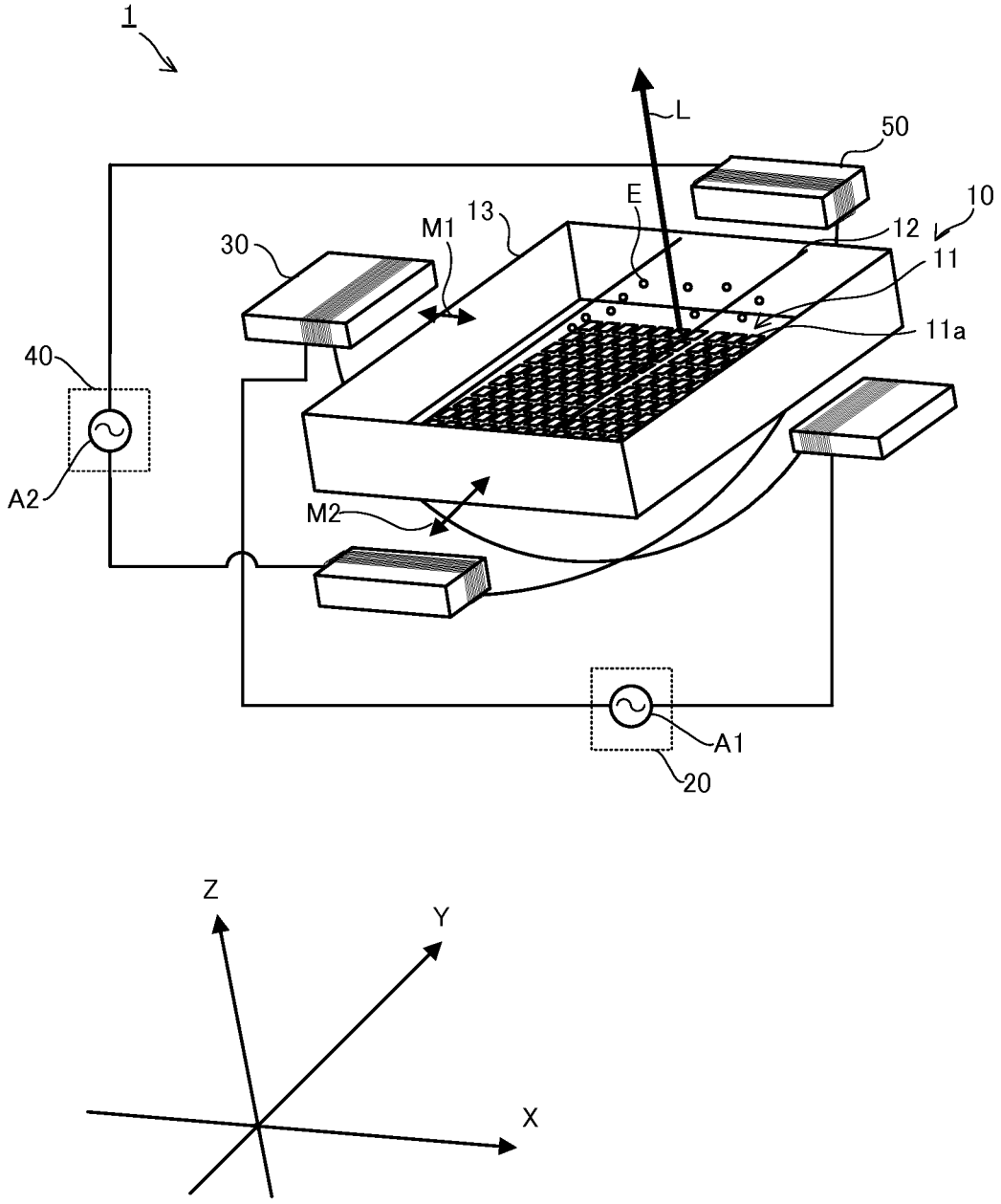
FIG. 1 is a schematic perspective view of a driving device for a vacuum fluorescent display according to an embodiment of the present invention.
Figure 2:
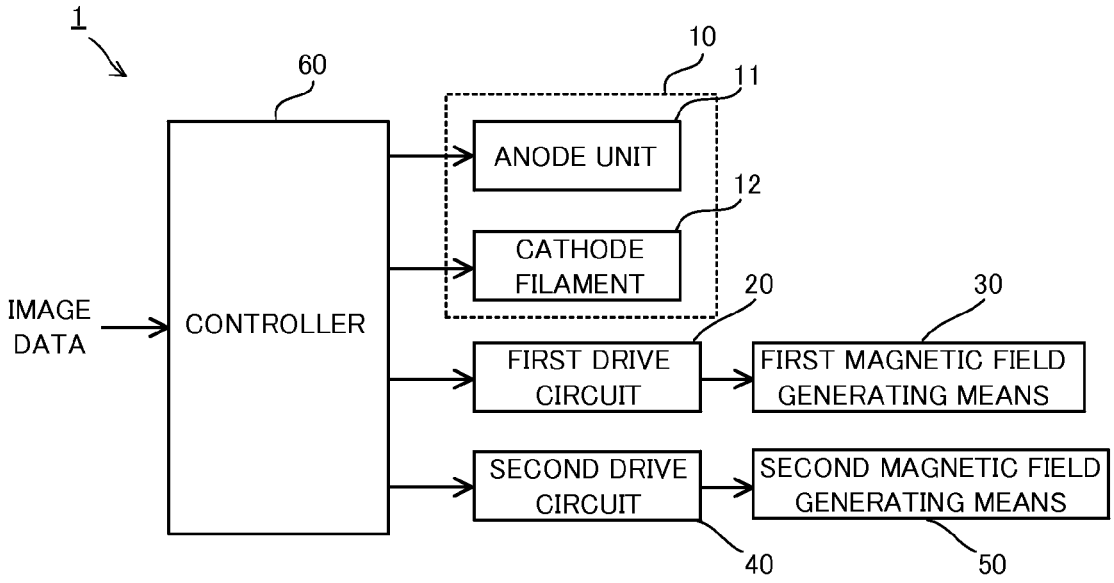
FIG. 2 is a diagram illustrating an electrical configuration of the same driving device for the vacuum fluorescent display.

FIG. 1 is schematic perspective view illustrating a driving device 1 for a vacuum fluorescent display, and FIG. 2 is a diagram illustrating an electrical configuration of the driving device 1 for the vacuum fluorescent display. The driving device 1 for the vacuum fluorescent display includes a vacuum fluorescent display 10, a first drive circuit 20, a first magnetic field generating means 30, a second drive circuit 40, a second magnetic field generating means 50, and a controller 60 as illustrated in FIGS. 1 and 2.

The vacuum fluorescent display 10 includes an anode unit 11, cathode filaments 12, and a sealing case 13 as illustrated in FIG. 1.

The anode unit 11 is constituted by a plurality of fluorescent substance-coated anodes 11*a* arranged in a matrix pattern on an unillustrated circuit board. A positive voltage (e.g., 5V) or a negative voltage (e.g., −35V; a filament voltage) is selectively applied to each anode 11*a* by a controller 60 and the anode 11*a* is switchable between an ON state in which the positive voltage is applied and an OFF state in which the negative voltage is applied.

A plurality of cathode filaments 12, made of thin metal wires, are disposed to face the anode unit 11 with a predetermined interval in a Z axis direction in FIG. 1. When a current is supplied from the controller 60, the cathode filaments 12 generate heat and emit thermoelectrons E. Further, a negative voltage (e.g., −35V; a filament voltage) is applied to the cathode filaments 12. The thermoelectrons E emitted from the cathode filaments 12 move toward the anodes 11*a* in the Z axis direction in FIG. 1 by the attractive force between the anode 11*a* in the ON state and the thermoelectrons E, and collide with the fluorescent substance applied to the anodes 11*a*. Then the fluorescent substance with which the thermoelectrons E, collide emits light, predetermined display light L is output to the outside, and a predetermined display image is displayed.

The sealing case 13, made of a glass material, is a case that accommodates the anode unit 11 and the cathode filaments 12. Inside of the sealing case 13 is kept in vacuum. A surface of the sealing case 13 on which the cathode filaments 12 are disposed (i.e., an upper surface in FIG. 1) is used as a display screen and the display light L is output from this display screen.

The first drive circuit 20 includes a first alternating current source A1, and supplies a first alternating current of a predetermined frequency to the first magnetic field generating means 30 from the first alternating current source A1 in accordance with control signals from the controller 60. The first drive circuit 20 can adjust the magnitude of the first alternating current.

The first magnetic field generating means 30 is constituted by a pair of coils each having a magnetic substance material as a core and disposed to face each other in an X axis direction in FIG. 1 via the vacuum fluorescent display 10. When the first alternating current is supplied, the first magnetic field generating means 30 generates, in a positive direction or a negative direction of the X axis in FIG. 1, a first magnetic field M1 of a direction vertical to a direction in which the anode unit 11 and the cathode filaments 12 face each other (i.e., the Z axis direction). That is, when the first alternating current is supplied, polarity of the first magnetic field generating means 30 is switched periodically, and the direction of the first magnetic field M1 is switched periodically to the reverse direction.

The second drive circuit 40 includes a second alternating current source A2, and supplies a second alternating current of a predetermined frequency to the second magnetic field generating means 50 from the second alternating current source A2 in accordance with control signals from the controller 60. The second drive circuit 40 can adjust the magnitude of the second alternating current.

The second magnetic field generating means 50 is constituted by a pair of coils each having a magnetic substance material as a core and disposed to face each other in a Y axis direction in FIG. 1 via the vacuum fluorescent display 10. When the second alternating current is supplied, the second magnetic field generating means 50 generates, in the positive direction or the negative direction of the Y axis in FIG. 1, a second magnetic field M2 of a direction vertical to a direction in which the anode unit 11 and the cathode filament 12 face each other (i.e., the Z axis direction). That is, when the second alternating current is supplied, polarity of the second magnetic field generating means 50 is switched periodically and the direction of the second magnetic field M2 is switched periodically to the reverse direction. By disposing the first magnetic field generating means 30 along the X axis direction and disposing the second magnetic field generating means 50 along the Y axis direction, the first magnetic field M1 and the second magnetic field M2 are vertical to the direction in which the anode unit 11 and the cathode filaments 12 face each other, and the first magnetic field M1 and the second magnetic field M2 cross vertically to each other.

The controller 60 is constituted by, for example, a microcomputer that includes a central processing unit (CPU) and a storage, such as read only memory (ROM), and a graphic display controller (GDC). The controller 60 applies a negative voltage to the cathode filaments 12 and supplies a current to cause the thermoelectrons E to be emitted, and selectively switches the ON state and the OFF state of each anode 11*a* in accordance with input image data. Thus, the controller 60 selectively causes the fluorescent substance coated on arbitrary anodes 11*a* to emit light and output display light L, and causes a display image, such as characters and figures, to be displayed on the vacuum fluorescent display 10. Further, the controller 60 outputs control signals to the first and the second drive circuits 20 and 40 in synchronization with the above-described display control, and causes the first and the second magnetic field generating means 30 and 50 to generate the first and the second magnetic fields M1 and M2.

Next, an effect of the first and the second electric fields M1 and M2 in the driving method of the present embodiment will be described.

Figure 3:
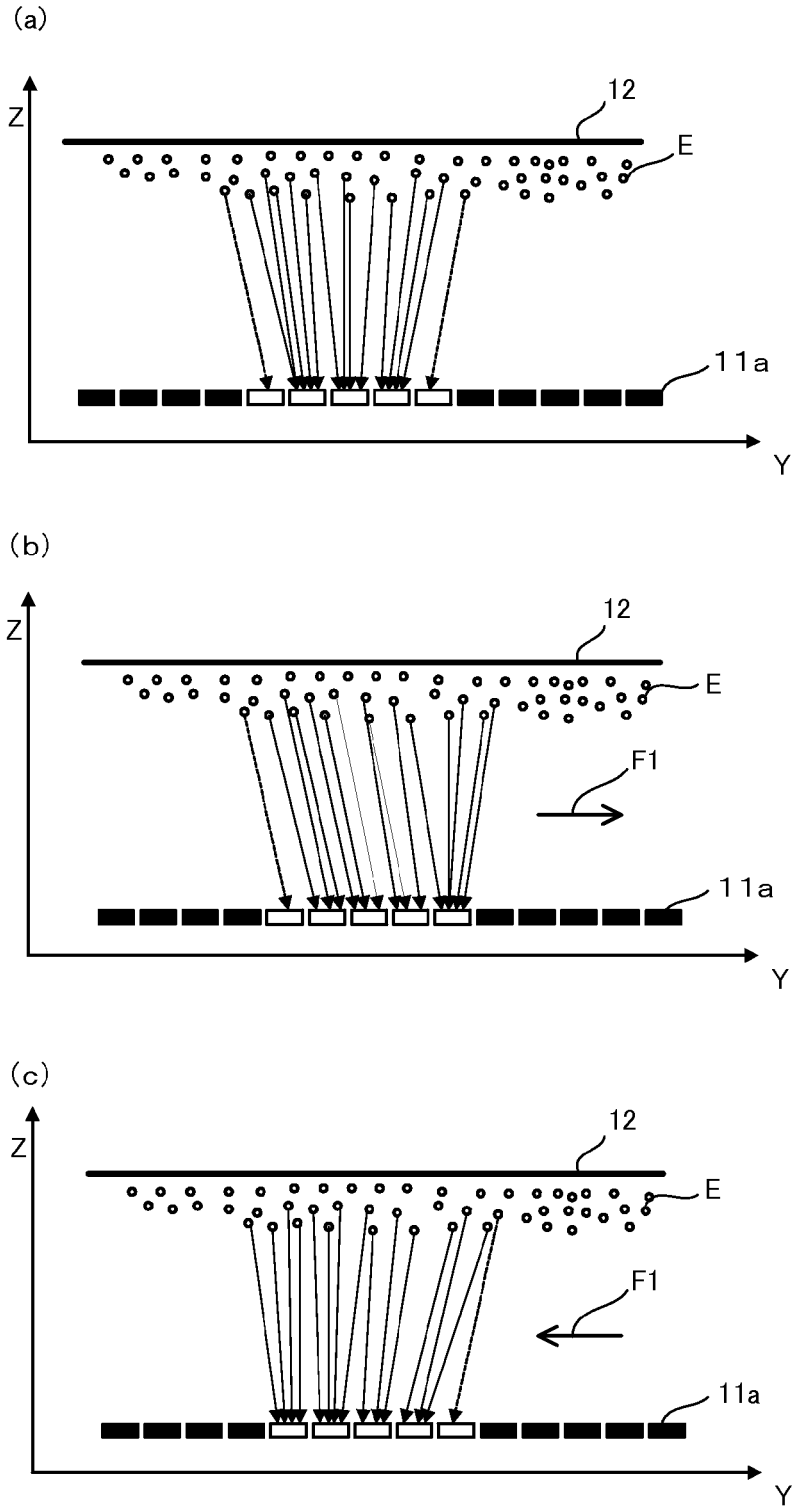
FIG. 3 is a diagram illustrating an effect of a first magnetic field in the same driving device for the vacuum fluorescent display.

FIG. 3 is a cross-sectional view of a main part taken along the Z-Y axes plane of FIG. 1. The anodes 11*a* illustrated in white in FIG. 3 are in the ON state (the positive voltage is applied), i.e., luminous dots, and the anodes 11*a* illustrated in black are in the OFF state (the negative voltage is applied), i.e., nonluminous dots. In a case in which the first and the second magnetic fields M1 and M2 are not to be generated, if there is a collection of luminous dots as illustrated in FIG. 3(*a*), the positive electric field generated from each luminous dot overlaps and the electric field in the central region of the collection of the luminous dots becomes stronger and the electric field in the peripheral region of the collection becomes weaker under the influence of the negative electric field generated by adjoining nonluminous dots. Therefore, the thermoelectrons E emitted from the cathode filaments 12 are attracted more strongly to the central region in which the positive electric field is strong. Thus, luminance becomes low in the peripheral region while luminance becomes high in the central region of the collection of the luminous dots, and luminance unevenness occurs in the display image.

However, when the first magnetic field M1 is generated by the first magnetic field generating means 30 in the positive direction of the X axis in FIG. 1, as illustrated in FIG. 3(*b*), the thermoelectrons E emitted from the cathode filaments 12 receive the first Lorentz force F1 in the positive direction of the Y axis in accordance with the Fleming's left-hand rule by the first magnetic field M1, and the thermoelectrons E moving toward the anodes 11*a* are deviated toward the positive direction of the Y axis and concentrate more on the luminous dots located in the positive direction of the Y axis. Thus, luminance of the collection of the luminous dots in the peripheral region located in the positive direction of the Y axis becomes high, and luminance in the peripheral region located in the negative direction of the Y axis becomes low.

Further, when the first magnetic field M1 is generated by the first magnetic field generating means 30 in the negative direction of the X axis in FIG. 1, as illustrated in FIG. 3(*c*), the thermoelectrons E emitted from the cathode filaments 12 receive the first Lorentz force F1 in the negative direction of the Y axis in accordance with the Fleming's left-hand rule by the first magnetic field M1, and the thermoelectrons E moving toward the anodes 11*a* are deviated toward the negative direction of the Y axis and concentrate more on the luminous dots located in the negative direction of the Y axis. Thus, luminance of the collection of the luminous dots in the peripheral region located in the negative direction of the Y axis becomes high, and luminance in the peripheral region located in the positive direction of the Y axis becomes low.

As described above, by supplying the first alternating current of a predetermined frequency to the first magnetic field generating means 30 and periodically switching the direction of the first magnetic field M1 to the reverse direction, the deviation of the thermoelectrons E in one direction vertical to the direction in which the anode unit 11 and the cathode filament 12 face each other (i.e., the Y axis direction) can be moved.

Figure 4:
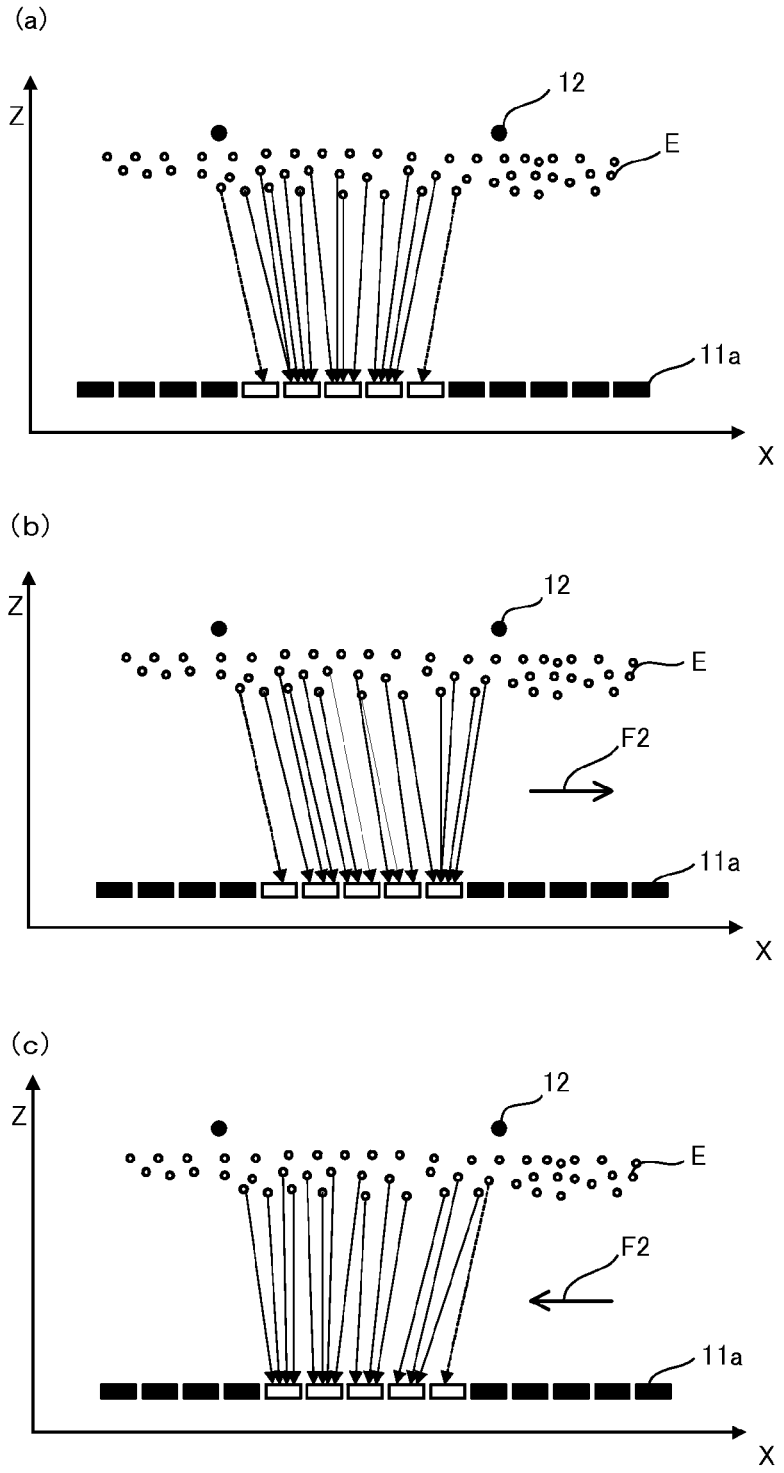
FIG. 4 is a diagram illustrating an effect of a second magnetic field in the same driving device for the vacuum fluorescent display.

FIG. 4 is a cross-sectional view of a main part taken along the Z-X axes plane of FIG. 1. The anodes 11*a* illustrated in white in FIG. 4 are in the ON state (the positive voltage is applied), i.e., luminous dots, and the anodes 11*a* illustrated in black are in the OFF state (the negative voltage is applied), i.e., nonluminous dots. In a case in which the first and the second magnetic fields M1 and M2 are not to be generated, if a plurality of luminous dots are collected as illustrated in FIG. 4(*a*), the positive electric field generated from each anode 11*a* overlaps and the electric field in the central region of the collection of the luminous dots becomes stronger and the electric field in the peripheral region becomes weaker under the influence of the negative electric field generated by adjoining nonluminous dots. Therefore, the thermoelectrons E emitted from the cathode filaments 12 are attracted more strongly to the central region in which the positive electric field is strong. Thus, luminance becomes low in the peripheral region while luminance becomes high in the central region of the collection of the luminous dots, and luminance unevenness occurs.

However, when the second magnetic field M2 is generated by the second magnetic field generating means 50 in the positive direction of the Y axis in FIG. 1, as illustrated in FIG. 4(*b*), the thermoelectrons E emitted from the cathode filaments 12 receive the second Lorentz force F2 in the positive direction of the X axis in accordance with the Fleming's left-hand rule by the second magnetic field M2, and the thermoelectrons E moving toward the anodes 11*a* are deviated toward the positive direction of the X axis and concentrate more on the luminous dots located in the positive direction of the X axis. Thus, luminance of the collection of the luminous dots in the peripheral region located in the positive direction of the X axis becomes high, and luminance in the peripheral region located in the negative direction of the X axis becomes low.

Further, when the second magnetic field M2 is generated by the second magnetic field generating means 50 in the negative direction of the Y axis in FIG. 1, as illustrated in FIG. 4(*c*), the thermoelectrons E emitted from the cathode filaments 12 receives the second Lorentz force F2 in the positive direction of the Y axis in accordance with the Fleming's left-hand rule by the second magnetic field M2, and the thermoelectrons E moving toward the anodes 11*a* are deviated toward the negative direction of the X axis and concentrate more on the luminous dots located in the negative direction of the X axis. Thus, luminance of the collection of the luminous dots in the peripheral region located in the negative direction of the X axis becomes high, and luminance in the peripheral region located in the positive direction of the X axis becomes low.

As described above, by supplying the second alternating current of a predetermined frequency to the second magnetic field generating means 50 and periodically switching the direction of the second magnetic field M1 to the reverse direction, the deviation of the thermoelectrons E in one direction vertical to the direction in which the anode unit 11 and the cathode filament 12 face each other (i.e., the X axis direction) is moved. Therefore, by periodically switching each of the directions of the first and the second magnetic fields M1 and M2 to the reverse direction, the deviation of the thermoelectrons E in two directions vertical to the direction in which the anode unit 11 and the cathode filament 12 face each other (i.e., the X axis direction and the Y axis direction) is moved and, whereby luminance unevenness can be reduced about the entire display image.

Figure 5:
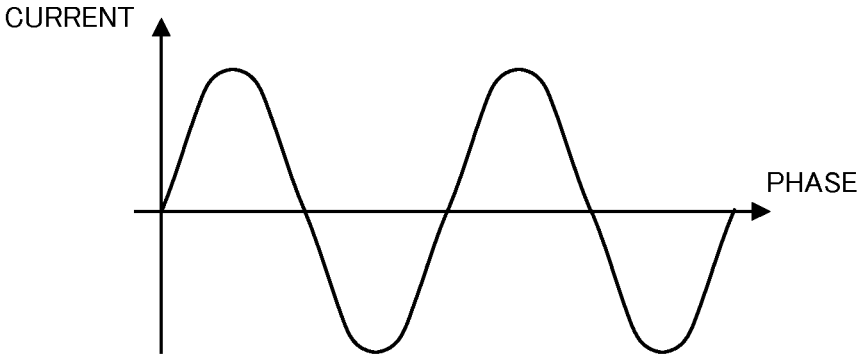
FIG. 5 is a diagram illustrating examples of a first and a second alternating currents in the same driving device for the vacuum fluorescent display.
Figure 5:
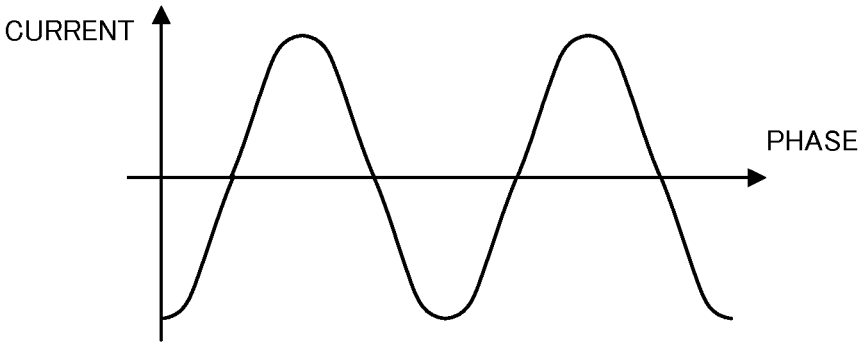
Figure 6:
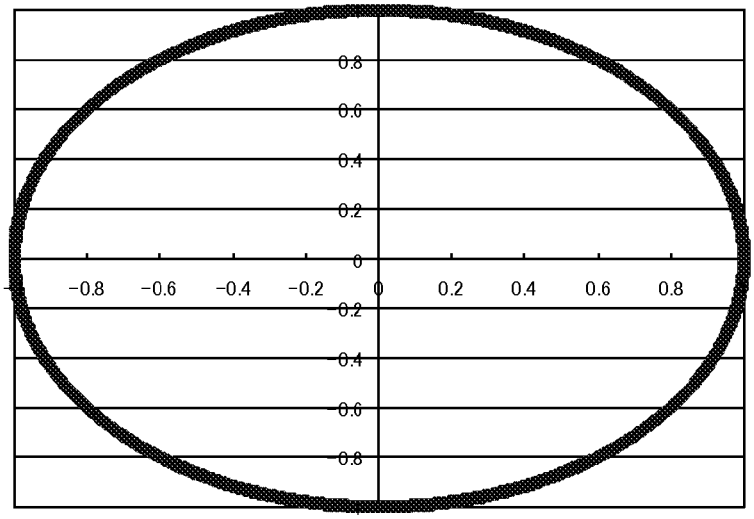
FIG. 6 is a diagram illustrating a path of a deviation of thermoelectrons in the same driving device for the vacuum fluorescent display.
Figure 6:
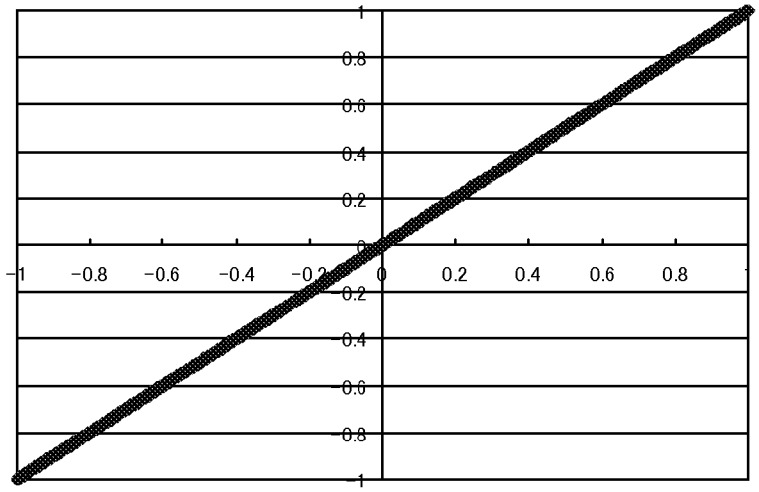

Next, prescription of the first and the second alternating currents for reducing the luminance unevenness about the entire display image of the vacuum fluorescent display 10 will be described. The first alternating current acts on the first magnetic field generating means 30 to generate the first magnetic field M1, and the second alternating current acts on the second magnetic field generating means 50 to generate the second magnetic field M2. Since the first magnetic field M1 and the second magnetic field M2 cross vertically each other, the first and the second Lorentz forces F1 and F2 acting on the thermoelectrons E also cross vertically each other. Further, since both the first and the second magnetic fields M1 and M2 are alternating current magnetic fields of which direction is periodically switchable, the direction of the Lorentz force that the thermoelectrons E actually receive when the first and the second magnetic fields M1 and M2 are synthesized, i.e., a path traced by the deviation of the thermoelectrons E, can be represented by a Lissajous's waveform (Lissajou's figure) in which the first magnetic field M1 is plotted on the Y axis and the second magnetic field M2 is plotted on the X axis. For example, a case in which sinusoidal currents having a phase difference of 90 degrees as illustrated in FIG. 5 are supplied to each of the first and the second electric field generating means 30 and 50 as the first and the second alternating currents will be considered (here, the amplitude values and the frequencies of the sinusoidal currents are supposed to be the same). The Lissajous's waveform representing the path of the deviation of the thermoelectrons E at this time has a substantially circular outer shape as illustrated in FIG. 6(*a*). Therefore, the deviation of the thermoelectrons E is moved to the entire peripheral region of the collection of the luminous dots that the thermoelectrons E have had difficulty in reaching, whereby luminance unevenness can be reduced about the entire display image. If the thermoelectrons E concentrate excessively on the peripheral region of the collection of the luminous dots, there is a possibility that luminance in the central region lowers, but the degree of deviation of the thermoelectrons E can be adjusted by suitably adjusting intensity of the first and the second magnetic fields M1 and M2, i.e., adjusting amplitude values (magnitudes) of the first and the second alternating currents. As an alternative, a case in which sinusoidal currents having a phase difference of 0 degrees (having the same phase) are supplied to each of the first and the second magnetic field generating means 30 and 50 as the first and the second alternating currents will be considered (here, the amplitude values and the frequencies of the sinusoidal currents are supposed to be the same). The Lissajous's waveform representing the path of the deviation of the thermoelectrons E at this time has a linear shape as illustrated in FIG. 6(*b*). Therefore, since the deviation of the thermoelectrons E is not moved to some of the regions (the upper left region and the lower right region) in FIG. 6(*b*), there is a possibility that reduction of the luminance unevenness becomes insufficient depending on the shape of the display image. Therefore, the first and the second alternating currents are desirably alternating currents having different phases (i.e., having a phase difference of greater than 0 degrees). Even if the phase is the same, by setting the frequencies of the first and the second alternating currents to be different, the Lissajous's waveform can be changed from the linear shape and the deviation of the thermoelectrons E can be moved to the entire peripheral region of the collection of the luminous dots. Further, regarding a vacuum fluorescent display having, for example, a rectangular display screen of 128×64 dots, by setting the amplitude values of the first and the second alternating currents to be different, the deviation of the thermoelectrons E can be moved to the peripheral region of the collection of the luminous dots also in the longitudinal direction. For example, in the case of a vacuum fluorescent display of 128×64 dots, since it is required to move the deviation of the thermoelectrons E further in the transverse direction (i.e., the X direction), a moving distance of the deviation of the thermoelectrons E in the transverse direction can be extended by setting the amplitude value of the second alternating current to be higher than the amplitude value of the first alternating current so that the second magnetic field generating means 50 generates greater second Lorentz force F2 in the transverse direction.

The driving device 1 for the vacuum fluorescent display which is the present embodiment is the driving device for the vacuum fluorescent display 10 that includes the anode unit 11 constituted by a plurality of fluorescent substance-coated anodes 11*a* arranged in a matrix pattern, and the cathode filaments 12 that emit electrons toward the anode unit 11, the device including: a first magnetic field generating means 30 that generates a first magnetic field M1 vertical to a direction in which the anode unit 11 and the cathode filaments 12 face each other, and of which polarity is switchable periodically; and a second magnetic field generating means 50 that generates the second magnetic field M2 vertical to a direction in which the anode unit 11 and the cathode filaments 12 face each other and crossing the first magnetic field M1, and of which polarity is switched periodically.

According to this, the deviation of the thermoelectrons E can be moved in two directions vertical to the direction in which the anode unit 11 and the cathode filaments 12 face each other (i.e., the X axis direction and the Y axis direction), luminance unevenness can be reduced about the entire display image, and display quality can be improved.

The first and the second alternating currents different in at least any one of amplitude value, frequency, and phase are respectively supplied to the second magnetic field generating means 30 and 50.

According to this, the deviation of the thermoelectrons E can be moved to the entire peripheral region of the collection of the luminous dots, the luminance unevenness can be reduced about the entire display image, and display quality can be improved.

The driving method for the vacuum fluorescent display which is the present embodiment is the driving method for the vacuum fluorescent display 10 that includes the anode unit 11 constituted by a plurality of fluorescent substance-coated anodes 11*a* arranged in a matrix pattern, and the cathode filaments 12 that emit electrons toward the anode unit 11, the method including generating, the first magnetic field M1 vertical to a direction in which the anode unit 11 and the cathode filaments 12 face each other and the second magnetic field M2 vertical to a direction in which the anode unit 11 and the cathode filaments 12 face each other and crossing the first magnetic field M1, with the directions switched periodically.

According to this, the deviation of the thermoelectrons E can be moved in two directions vertical to the direction in which the anode unit 11 and the cathode filaments 12 face each other (i.e., the X axis direction and the Y axis direction), luminance unevenness can be reduced about the entire display image, and display quality can be improved.

Further, the first and the second magnetic fields M1 and M2 are generated by the first and the second alternating currents different in at least any one of amplitude value, frequency, and phase.

According to this, the deviation of the thermoelectrons E can be moved to the entire peripheral region of the collection of the luminous dots, the luminance unevenness can be reduced about the entire display image, and display quality can be improved.

In the above description, for the ease of understanding of the present invention, description of publicly known technical matters that are not important is omitted as necessary. The present invention is not limited to the above-described embodiment and may be modified (including deletion of components) as necessary without departing from the scope of the present invention.

INDUSTRIAL APPLICABILITY

The present invention is suitably applicable to a driving device and a driving method for a vacuum fluorescent display.

REFERENCE NUMERALS

1 driving device for vacuum fluorescent display
10 vacuum fluorescent display
11 anode unit
11*a* anode
12 cathode filament
13 sealing case
20 first drive circuit
30 first magnetic field generating means
40 second drive circuit
50 second magnetic field generating means
A1 first alternating current source
A2 second alternating current source

The invention claimed is:

1. A driving device for a vacuum fluorescent display which includes an anode unit constituted by a plurality of fluorescent substance-coated anodes arranged in a matrix pattern, and a cathode filament that emits electrons toward the anode unit, the device comprising:

a first magnetic field generating means configured to generate a first magnetic field vertical to a direction in which the anode unit and the cathode filament face each other, and of which polarity is switchable periodically; and a second magnetic field generating means configured to generate a second magnetic field vertical to a direction in which the anode unit and the cathode filament face each other and vertically crossing the first magnetic field, and of which polarity is switchable periodically.

2. The driving device of the vacuum fluorescent display according to claim 1, wherein a first and a second alternating currents different in at least any one of amplitude value, frequency, and phase are respectively supplied to the first and the second magnetic field generating means.

3. A driving method for a vacuum fluorescent display which includes an anode unit constituted by a plurality of fluorescent substance-coated anodes arranged in a matrix pattern, and a cathode filament that emits electrons toward the anode unit, the method comprising generating a first magnetic field vertical to a direction in which the anode unit and the cathode filament face each other and a second magnetic field vertical to a direction in which the anode unit and the cathode filament face each other and vertically crossing the first magnetic field, with the directions switched periodically.

4. The driving method for the vacuum fluorescent display according to claim 3, wherein the first and the second magnetic fields are generated respectively by the first and the second alternating currents different in at least any one of amplitude value, frequency, and phase.

* * * * *